US005247712A

United States Patent [19]

Williams

[11] Patent Number: 5,247,712

[45] Date of Patent: Sep. 28, 1993

[54] INFLATABLE BATHING DEVICE

[76] Inventor: Prune P. Williams, E301, 215 Market St., Galveston, Tex. 77550

[21] Appl. No.: 830,917

[22] Filed: Feb. 4, 1992

[51] Int. Cl.[5] ..... A47K 3/02

[52] U.S. Cl. ..... 4/585; 4/538; 4/584; 4/588

[58] Field of Search ..... 4/585, 588, 584, 538, 4/534

[56] References Cited

U.S. PATENT DOCUMENTS

| | | | |
|---|---|---|---|
| 2,471,302 | 5/1949 | Boward | 4/588 |
| 2,799,025 | 7/1957 | Kepler | 4/595 |
| 3,058,122 | 10/1962 | McDaniel et al. | 4/588 |
| 3,681,789 | 8/1972 | Bott | 4/584 X |
| 4,023,220 | 5/1977 | Younker | 4/585 |
| 4,583,252 | 4/1986 | McCourt | 4/584 |
| 4,964,183 | 10/1990 | La Force, Jr. | 4/457 X |
| 5,022,102 | 6/1991 | Louvaris | 4/516 |

*Primary Examiner*—Daniel M. Yasich

*Attorney, Agent, or Firm*—Richard C. Litman

[57] ABSTRACT

A bathing device for use in a hospital or nursing home environment comprises a rectangular chamber surrounded on five sides by inflatable interconnected panels. An integral head and neck support are provided at one end of the rectangular chamber. A drain unit penetrates the chamber and is connected to a hose for drainage of the bathing device. Air is provided to the interconnected panels through a resealable inlet. Air is also provided to the head and neck support though a resealable inlet. The bathing device is designed to be utilized in a hospital bed. A sloped inflated bottom panel facilitates drainage.

4 Claims, 2 Drawing Sheets

INFLATABLE BATHING DEVICE

FIELD OF THE INVENTION

The present invention relates to devices utilized in a hospital to bathe a patient who is fully or partially immobilized. More particularly the instant invention relates to an inflatable bathtub which may be easily employed to comfortably bathe a person with limited ambulatory capacity.

DESCRIPTION OF THE PRIOR ART

Devices which are both inflatable and utilized in the bathing or treatment of immobilized individuals are known in art. U.S. Pat. No. 3,058,122 issued to B. B. McDaniel et. al. on Oct. 16, 1962 discloses a thermoplastic film lavage device for treating victims of a thermonuclear conflagration. The device is inflatable and designed to hold the victim while burn treatments such as spray and lavage are applied. A drain and head rest are provided.

U.S. Pat. No. 3,681,789 issued to Edward Bott on Aug. 8, 1972 discloses a self-supporting bathing receptacle of compliant material for bathing a person therein. The device includes a drain tube and an inflatable tubular channel surrounding the bathing zone.

U.S. Pat. No. 4,964,183 issued to James LaForce, Jr. on Oct. 23, 1990 discloses a solar tanning tub. An inflatable enclosure and back and neck support are designed to allow the user to comfortably recline inside the enclosure while being partially immersed in water. The device may be deinflated and folded for storage.

U.S. Pat. No. 5,022,102 issued to Maria Louvaris on Jun. 11, 1991 discloses a bathing device comprising the combination of an inflatable bathtub and a shampoo bowl of flexible material. Drains are provided at both ends of the longitudinal axis of the inflatable bathtub.

None of the above referenced devices, considered either singly or in combination, is seen to suggest the instant invention as claimed.

SUMMARY OF THE INVENTION

A bathing device for use in a hospital or nursing home environment comprises a rectangular chamber surrounded on five sides by inflatable interconnected panels. An integral head and neck support are provided at one end of the rectangular chamber. A drain unit penetrates the chamber and is connected to a hose for drainage of the bathing device. Air is provided to the interconnected panels through a resealable inlet. Air is also provided to the head and neck support though a resealable inlet. The bathing device is designed to be utilized in a hospital bed. The bathing device is placed on the hospital bed in its uninflated condition. The immobilized person while in an inclined position is placed thereon. The five interconnected panels and head/neck support are then inflated. Water is introduced and the patient/user is cleaned. The soiled water is then drained from the bathing device to an appropriate disposal unit. A sloped inflated bottom facilitates drainage. The unit is deflated, and the patient/user is removed and dried. The bathing unit is then sterilized or destroyed as required or necessary.

Accordingly, one object of the present invention is to provide a simple to use inflatable bathing device.

Another object of the present invention is to provide an inflatable bathing device for use with immobile individuals.

Another object of the present invention is to provide an inflatable bathing device which is easy to drain.

Another object of the present invention is to provide an inflatable bathing device which has features to ensure the comfort of the user.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
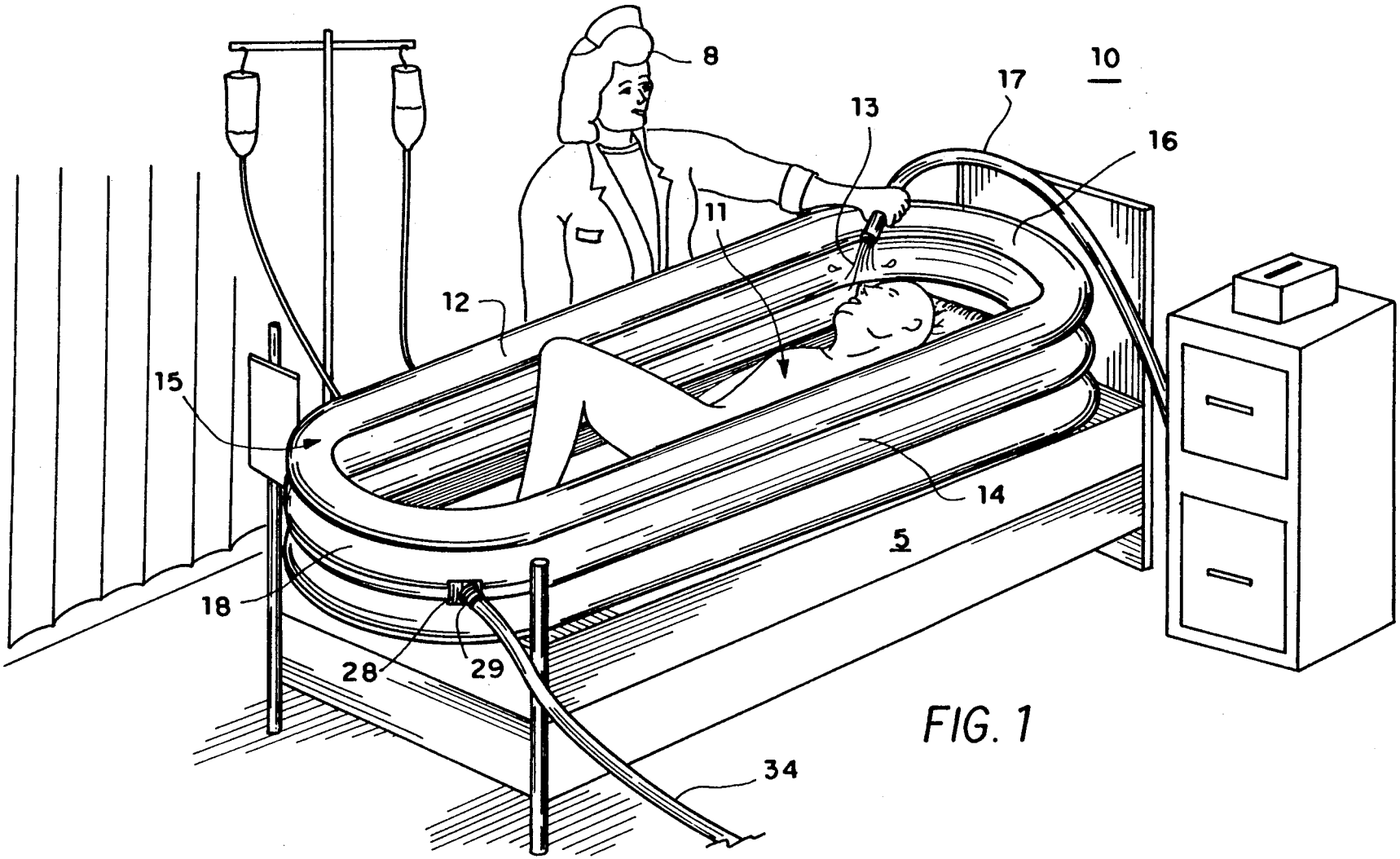
FIG. 1 is an environmental perspective view of a patient being bathed in the instant invention.

An inflatable bathing device or tub 10 is provided for use with a patient 11 confined to a bed 5 in a hospital or a nursing home. The bathing device 10 comprises a right side wall 12, a left side wall 14, a head side wall 16, and a foot side wall 18, connected to a bottom element 20. The upright side walls (12, 14, 16, 18) and the bottom element 20 are inflatable and are composed of generally cylindrical tubular members 15. The bottom element 20 has a top portion 21 and a foot or lower portion 23. The top portion 21 is higher than the lower portion 23, thus creating a interior slope on the bottom element 20. A drain outlet 28 is provided at the intersection of the lower portion 23 with the left side wall 14. This drain outlet 28 passes through the foot side wall 18 and would permit fluid to drain from the tub 10. The drain outlet 28 is connected to a drain hose 34 externally of the tub 10 to permit remote disposal of the used water. Any of a variety of means may be employed to connect the hose 34 to the drain outlet 28. A plug 32 is provided to maintain tub 10 integrity while being employed.

Referring now to FIG. 1, the inflatable tub 10 is shown in use, with an orderly 8 bathing an incapacitated patient 11 while a substantial portion of the patient's body is immersed in water. Water 13 is brought to the tub 10 from a hot water supply by a hose 17. The tub 10 is in its inflated position and is shown with the drain hose 34 connected. The drain hose 34 leads to a suitable dirty water disposal site such as the bathroom. Gravity would cause the water to drain once the plug 32 which is provided is removed.

Figure 2:
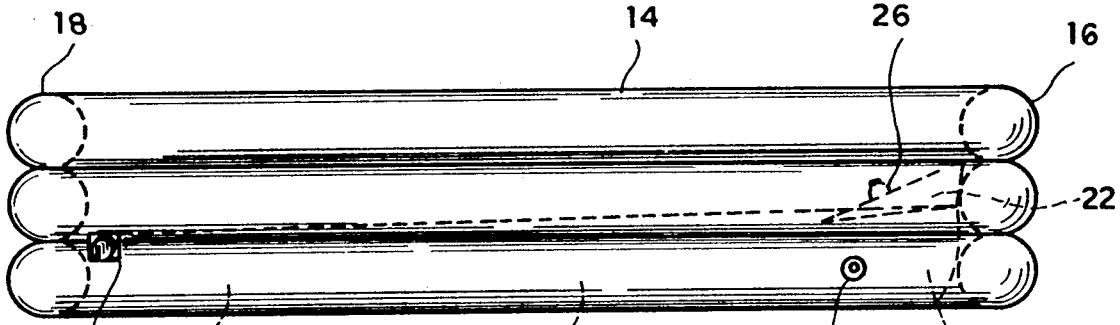
FIG. 2 is a right side view of the instant invention.

Referring now specifically to FIG. 2, the sloped nature of the bottom inflatable element 20 is shown. An inflatable pillow 22 is provided secured to the top portion 23 of the bottom element 20. The drain outlet 28 is shown penetrating the foot side wall 18 proximal the lower portion 23 of the bottom element 20. The bottom element 20 is shown in dashed lines, sloping downward from the head wall 16 to the foot wall 18. An air input valve 24 is provided on the left side wall 14. The air input valve 24 is resealable and permits the air tubes 15 to be filled to a desired pressure. The four wall elements (12, 14, 16, 18) are composed of cylindrical air tubes 15 which are made of plastic or other suitable material such as rubberized cloth. The air tubes 15 are integral and connected in such a way that the one resealable air valve 24 would permit inflation of the entire tub 10.

Figure 3:
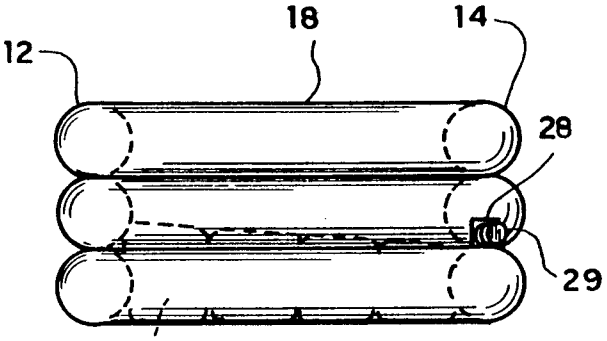
FIG. 3 is a front view of the instant invention.

FIG. 3 is a view showing the further sloping of the bottom element 20 from the right side wall 12 toward the left side wall 14 to facilitate water drainage. The drain outlet 28 is shown penetrating the foot side wall 18.

Figure 4:
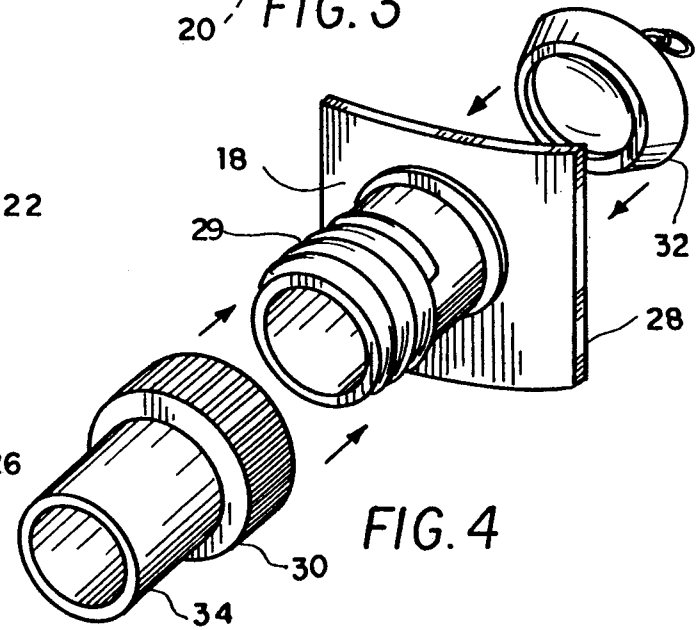
FIG. 4 is a partial side view showing the drain coupling.

The drain outlet 28 is shown in FIG. 4. A plug 32 can be employed to prevent drainage of the tub 10. The drain outlet 28 has a conventional screw hose mounting 29 attached in the preferred embodiment; however, one of any of a host of hose securing means may be employed to secure the drain hose 34 to the drain outlet 28 by coupling 30. The drain hose 34 is brought to a suitable disposal area where the waste water would be disposed of.

Figure 5:
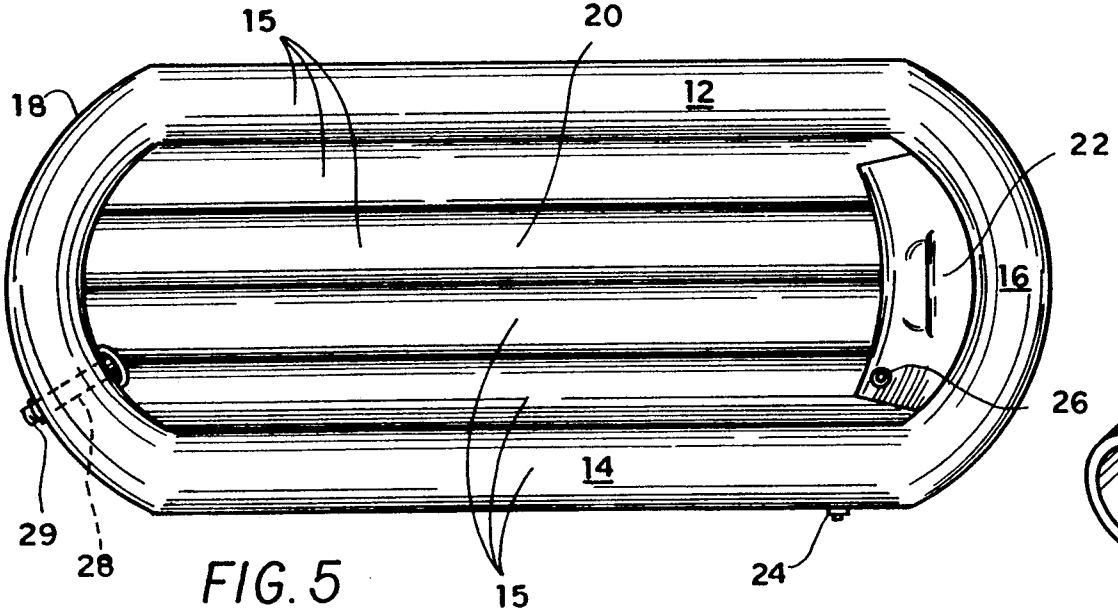
FIG. 5 is a top plan view of the instant invention.

FIG. 5 shows a top plan view of the instant invention. It shows the integral nature of the cylindrical air tubes 15. The bottom inflatable element 20 is comprised of a plurality of connected cylindrical air tubes 15 which are also filled by the master air valve 24. An inflatable pillow 22 is shown with its own resealable air input valve 26.

It is to be understood that the present invention is not limited to the sole embodiment described above, but encompasses any and all embodiments within the scope of the following claims.

I claim:

1. A rectangularly shaped inflatable device for bathing a person in an incline position while a substantial portion of the patient's body is immersed in water, said device comprising:

an inflatable bottom member having a rectangular perimeter;

four upright inflatable side members integrally connected to the bottom member about said perimeter, said four upright inflatable side members including a right side, a left side, a head side and a foot side;

a resealable air valve disposed at said head side;

drain means penetrating said foot side generally towards the left side; and said inflatable bottom member being interiorly sloped from said head side towards said foot side, and additionally sloped from said right side towards said left side to allow the water to readily drain by gravitational attraction through said drain means.

2. A device as claimed in claim 1 wherein said drain means comprises a drain outlet, said drain outlet having an interior portion and an exterior portion, said exterior portion having connection means to connect said drain outlet to a hose, said interior portion designed to receive a plug, whereby said device may hold water until said plug is removed, and then said device will drain through said drain outlet to a water disposal area.

3. A device as claimed in claim 1 wherein said inflatable bottom and said inflatable four sides are interconnected tubular members designed to receive air.

4. A device as claimed in claim 1 having an inflatable pillow, said pillow having a second resealable air valve located thereon, said pillow located proximal to said head wall and secured to said inflatable bottom.

* * * * *